US006077129A

United States Patent [19]

Silfverberg

[11] Patent Number: 6,077,129

[45] Date of Patent: Jun. 20, 2000

[54] CONNECTOR FOR MAKING AND SEALINGLY ENCLOSING AN ELECTRICAL CONNECTION

[76] Inventor: Kim Silfverberg, Docentbacken 11, Stockholm, Sweden, 104 05

[21] Appl. No.: 09/155,570

[22] PCT Filed: Mar. 24, 1997

[86] PCT No.: PCT/SE97/00508

§ 371 Date: Oct. 1, 1998

§ 102(e) Date: Oct. 1, 1998

[87] PCT Pub. No.: WO97/37402

PCT Pub. Date: Oct. 9, 1997

[30] Foreign Application Priority Data

Apr. 3, 1996 [SE] Sweden ..... 9601298
Nov. 11, 1996 [SE] Sweden ..... 9604114

[51] Int. Cl.[7] ..... H01R 11/03

[52] U.S. Cl. ..... 439/790; 174/87

[58] Field of Search ..... 439/930, 790, 439/723, 724, 794, 708; 174/87, 88 R, 88 S, 84 S

[56] References Cited

U.S. PATENT DOCUMENTS

| | | | |
|---|---|---|---|
| 1,458,247 | 6/1923 | Schleper . | |
| 2,275,762 | 3/1942 | Horton | 173/328 |
| 2,416,943 | 3/1947 | Nicolazzo | 174/87 |
| 2,910,525 | 10/1959 | Frank | 174/87 |
| 2,925,461 | 2/1960 | Anderson | 174/87 |
| 4,107,453 | 8/1978 | Erixon | 174/87 |
| 4,163,868 | 8/1979 | Stotts | 174/87 |
| 4,446,332 | 5/1984 | Dauser, Jr. | 174/87 |
| 5,099,089 | 3/1992 | Zan | 174/87 |
| 5,531,618 | 7/1996 | Market | 439/840 |

*Primary Examiner*—Neil Abrams
*Assistant Examiner*—Brian S. Webb
*Attorney, Agent, or Firm*—Jacobson, Price, Holman & Stern, PLLC

[57] ABSTRACT

A connector having a first tubular body and a second cupped body for coaxially embracing the first body. One end section of a cable is fitted through the first body and the stripped conductor section of the cable is then folded back against the outer surface of the first body. The cupped second body is then pushed axially over the tubular first body and the bare conductor end-parts resting thereon, so as to clamp the bare conductor end-parts between the outer mantle surface of the first body and the inner mantle surface of the second body. The first body is constructed so as to be subjected to radial elastic compression when the effective outer diameter of the first body and the conductor end-parts are larger than the effective inner diameter of the second body, thereby ensuring effective clamping of the conductor end-part between said two bodies even when the bare conductor end-part has a varying diameter or effective thickness, and even when the number of conductors to be connected between the two connector bodies vary in number. Through such clamping, a sealed enclosure is formed that tightly shields the stripped end-parts of the cable from the surroundings and prevents oxidation and other corrosion of the contact surfaces.

17 Claims, 2 Drawing Sheets

CONNECTOR FOR MAKING AND SEALINGLY ENCLOSING AN ELECTRICAL CONNECTION

BACKGROUND OF THE INVENTION

1. Field of the Invention

The present invention relates to a connector that includes a first body having a through-passing channel for at least one cable, and a second body that includes a recess which is dimensioned to receive the first body and a cable end-part that is folded back against the mantle surface of the first body.

2. Description of the Related Art

Connectors of this kind are known from U.S. Pat. No. 1,458,247 for instance. A connector of this kind can be used either to enclose and electrically insulate conductor end-parts of an electric cable that have been stripped of their insulation, or to establish mutual electrical connection of several conductor end-parts.

In the known technique, the end-parts are clamped between two matching conical surfaces of which one is in screw coaction with a central screw. In order to insulate the connector, it is necessary to encase the connector in an electrically insulating cover.

Connectors of this known kind have many drawbacks. One drawback can be said to lie in the dependency of conductor attachment on the intrinsic elasticity of the conductor. Another drawback is that a pressure joint is required between the elements that fasten the end of the conductor. It is also impossible to seal the cable transit through the first body in a simple manner. Furthermore, there is no simple way in which the stripped end-part can be sealed within the connector.

SUMMARY OF THE INVENTION

Accordingly, one object of the invention is to provide a connector which will enable the conductor to be fastened in a simple fashion and to enable different sized conductors or a plurality of conductors to be fastened in the absence of a screw joint.

A further object is to provide a connector which enables the stripped end-parts of the cable/cables to be tightly enclosed within the connector.

These objects are achieved totally or partially with a connector for receiving at least one stripped conductor end-part of a cable, wherein the connector includes a first body having a through-passing cable accommodating channel, and a second body that includes a recess which is intended to receive the first body and said endpart, folded down onto the perimeter surface of the first body. The first body is radially deformable relative to the second body so as to clamp the conductor end-part between said bodies. The cross-sectional shape of the channel in the first body corresponds to the outer contour of a plurality of cables to be received in the connector and tightly combined parallel with one another. The second body is dimensioned such that when fitted onto the first body, the second body will cause an axial region of the first body to be compressed so that the channel wall of the first body will lie sealingly around the contour of the insulated parts of the combined cables while, at the same time, the cables sealingly connect with one another so as to shield the channel cross-section. In addition, the second body is cupped and the edge-part of the second body is adapted to seal against the perimeter of the first body.

Further embodiments of the inventive connector include dimensioning of the second body so as to elastically compress the first body in an axially extending region of the first body when the second body is fitted onto the first body, such as to bring the channel wall of the first body into sealing engagement with the perimeter of the cable insulation while elastically clamping the stripped conductor-part radially between the bodies at the same time. The perimeter or mantle surface of the first body may further include at least one generally axially extending groove adapted to receive the mutually twisted stripped end-parts of a number of cables corresponding to the number of openings in the first body. In a further embodiment, the second body is electrically conductive. The inventive connector may also be embodied such that at least an axially extending part-region of the inner surface of the second body or the outer surface of the first body is electrically conductive for electrically connecting stripped cable conductors that are clamped between the adjacent surfaces of the first body and the second body. The invention may also be embodied such that the channel in the first body has an outlet part whose cross-sectional size is smaller than the cross-sectional size of the channel inlet but larger than the cross-sectional size of the mutually twisted cable conductors. The invention may also be embodied such that the channel outlet part is centered in relation to the cross-sectional shape of the channel inlet part.

The inventive connector comprises basically a first tubular body and a second cupped body that is intended to embrace the first body generally coaxially. One end section of the cable can be fitted through the first tubular body and the stripped conductor section of the cable then folded back against the outer surface of the first tubular body. The cupped second body can now be pushed axially over the tubular first body and the bare conductor end-parts resting thereon, so as to clamp the bare conductor end-parts between the outer mantle surface of the first body and the inner mantle surface of the second body. The first tubular body is constructed so as to be subjected to radial elastic compression when the effective outer diameter of the tubular first body and the conductor end-parts are larger than the effective inner diameter of the second body, therewith ensuring effective clamping of the conductor end-part between said two bodies even when the bare conductor end-part has a varying diameter/effective thickness, and even when the number of conductors to be connected between the two connector bodies vary in number.

According to one favorable embodiment of the invention, the tubular first body may include transit channels that are adapted closely to the outer diameter of the insulated cable part, such that as the second body is pushed over the first body said first body will be compressed radially and therewith bring the walls of the transit channel into sealing contact with the outer peripheral surface of the cable. The transits through the first body will therewith be completely sealed.

In another preferred embodiment, the second body is constructed so that its edge region will come into contact around the whole of its periphery with a peripheral region of the tubular first body, so as to tightly shield the stripped end-section of the cable from the surroundings. This sealed enclosure is effective in reducing oxidation of the contact surfaces between conductor end-parts and/or contact tabs against which said end-parts lie.

The cable insulation can be brought into sealing contact with the wall of the cable transit as a result of radial compression of the first body by said second body as said second body is fitted onto the first body. Alternatively, the inner end of the first body may be provided with a diametrical slit that intersects the cable transit and divides the inner end-part into tongues that bend towards one another and towards an insulated cable section when fitting the second body. These tongues exert a displacing force onto the cable insulation such that said insulation will tend to flow along the cable and the cable transit in a direction towards the rear or distal end of the first body, such as to cause the cable, or more specifically the cable insulation, to swell at or in that part of the cable that lies adjacent the bottom of the slit.

The tongues formed by slitting the inner end of the first body may be configured so that the tongues and the clamped cables together will assume a preferably circular cross-sectional shape that corresponds to the cross-sectional shape of the associated part of the second body as the tongues and cables are inserted therein.

The second body may typically include on its inner wall surface a peripheral part of an electrically conductive material that provides a bridge between several stripped conductor end-parts located in the peripheral gap between the first and the second bodies. According to one embodiment, the second body may have an outer surface that is at least partially comprised of electrically conductive material and that is in conductive connection with the conductors located within the connector, such that the second body in principle forms a male plug on the end of the cable concerned, wherein the male plug may be adapted to be plugged into a corresponding female socket. Naturally, the second body may alternatively form a female socket connected electrically conductively to the conductor end-parts in the connector.

Cable tension is relieved effectively by virtue of the stripped conductor end-sections being folded back through 180 degrees and therewith may be bent over 90 degree edges.

In the case of certain embodiments of the invention, particularly when the conductors are multi-wire conductors, it may be appropriate to first twist together the stripped conductor-ends to form a single twisted conductor end-part. This conductor end-part is cut to a suitable length and placed in an axially extending recess on the outer mantle surface of the tubular body. The electrical connection between the conductors is favoured by twisting the conductor-ends together and also by bending the twisted cable end. The groove intended to receive the twisted conductors may be dimensioned to accommodate the number of conductors concerned, particularly when each cable passes through a size-adapted transit in the first body and then clamped tightly therein when the second body is pushed over the first body.

The tubular first body will preferably have at its cable receiving end a radially and outwardly projecting peripheral flange or lip, and the inner surface of the cupped second body will have on its edge-part a formation that corresponds to said flange or lip and that enables the first and the second body to connect tightly therearound. The connection will preferably have the form of a non-releasable snap connection. The first body may be produced from an elastomeric material, whereas the second body may be much more rigid than the first body and may be produced from a rigid plastic material.

The material from which the bodies are made, however, is of lesser importance than the desired function, and it will be evident to the skilled person that an electrically conductive peripheral part may be provided either on the outside of the first body or on the inside of the second body such as to mutually connect electrically the conductors in the connector.

BRIEF DESCRIPTION OF THE DRAWINGS

The invention will now be described in more detail with reference to exemplifying embodiments thereof and also with reference to the accompanying drawings.

DETAILED DESCRIPTION OF THE PREFERRED EMBODIMENTS

Figure 1:
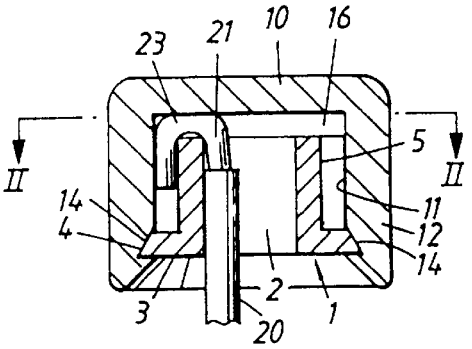
FIG. 1 is a schematic axial section view of an inventive connector.
Figure 2:
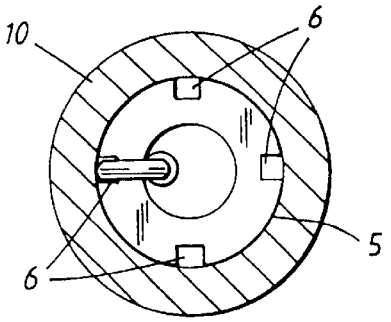
FIG. 2 is a sectional view taken on the line II—II in FIG. 1.

FIGS. 1 and 2 illustrate a connector that includes a generally tubular first body 1 that has a through-passing opening 2. The body 1 has at one end a peripheral ring flange 3 provided with a bevelled edge 4.

The connector also includes a cupped second body 10 that has an inner wall 11 which surrounds the outer mantle wall 5 of the first body 1. Also shown is a cable 20 that includes a conductor 21 having a stripped end-part 23. The cable 20 extends through the opening or transit 2, wherewith the end-part 23 of said conductor is bent around the mantle wall 5. The second body 10 is pushed axially over the first body 1 and the bent end-part 23 such as to clamp the end-part 23 radially between the surfaces 5 and 11.

Provided on the inner surface of the free edge-part 12 of the second body 10 is a peripherally extending recess 14 which receives the bevelled edge 4 of the ring flange 3. The second body 10 can be considered as an essentially rigid body, whereas the first body 1 can be considered as being elastically deformable in a radial direction. The first body 1 is dimensioned so that conductors 21 of typical sizes will be clamped between the wall surfaces 5 and 11 when the second first body 10 is fitted over the first body 1. The recess 14 is preferably adapted to provide a snap joint in coaction with the bevelled edge 4 when the second body 10 is fitted over the first body 1, said snap joint preferably being adapted to provide a seal between the edge-part 12 and the ring flange 3 around its periphery. The snap joint will also preferably include angles in a known manner, that make opening of the joint difficult to achieve.

The perimeter of the first body 1 may include one or more axially extending conductor-receiving grooves or recesses 6, said grooves functioning to distribute engagement deformation of the first body 1 around its periphery.

The second second body 10 may include a ring of electrically conductive material on its inner cylindrical surface, for contact with the bent end-parts 23 of the conductors 21. Alternatively, that edge-part of the first body 1 that lies in contact with the end-parts 23 may be made electrically conductive so as to mutually connect several cables mounted like cable 20 in the connector shown in FIG. 1.

Naturally, the whole of the second body 10 may be comprised of an electrically conductive material when the second body 10 is to form an electric plug.

The skilled person will also realize that the second body 10 may carry an electric plug and that the plug may be connected electrically with the conductors 21 within the connector in a conventional manner.

The opening 2 of the first body 1 in FIGS. 1 and 2 is shown to be much larger than the cable 20.

Figure 3:
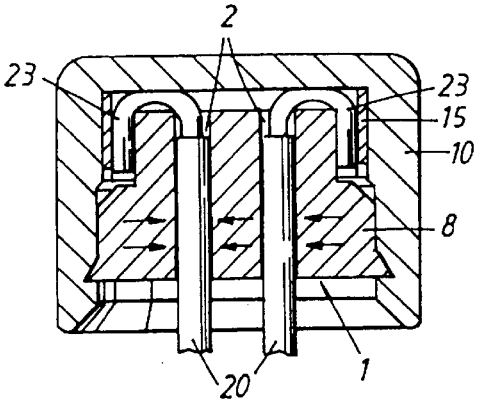
FIG. 3 is a schematic axial section view of another embodiment of an inventive connector.

In the FIG. 3 embodiment, the first body 1 includes an opening or transit 2 for each cable 20 to be connected to the connector.

The dimensions of the opening/transit 2 are closely adapted to the size of the cable 20, and the first body 1 includes a part 8 that is intended for powerful coaction with a corresponding peripheral part on the mantle wall of the second body 10, such as to generate radial compression of the first body 1 so that said first body is compressed and respective transit walls are brought into tight abutment around respective cables in this region when said second body 10 is mounted properly on the first body 1. The first body 1 of the FIG. 3 embodiment is also dimensioned to establish elastic clamping of the end-part 23.

Figure 4:
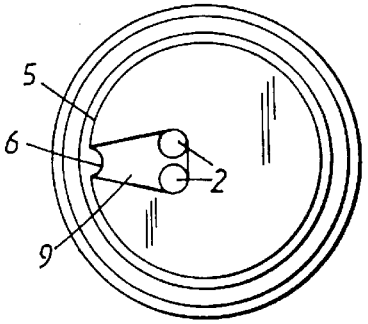
FIG. 4 is an end view of one component body of an inventive connector, in a modified version of the embodiment illustrated in FIG. 3.

FIG. 4 illustrates an embodiment having a first body 1 that corresponds essentially to the first body of the FIG. 3 embodiment but with the difference that the openings 2 open out into a radial channel 9 on the inner short end of the first body 1. The conductor end-parts 23, particularly in the case of multi-wire conductors, can be twisted together and then laid into the radial channel 9 and thereafter laid down in the axially extending outer groove 6 on the outer mantle surface 5 of the first body 1.

In the FIG. 3 embodiment, the second body 10 has internally a conductor sleeve 15 that enables the conductors 21 of cables 20 to be mutually connected electrically even when the conductors are mutually spaced around the perimeter of the first body 1.

Figure 5:
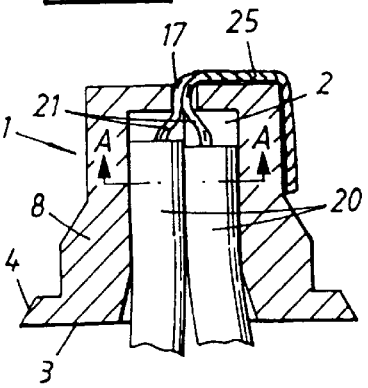
FIG. 5 is an axial section view of the tubular inner part of an inventive connector.
Figure 6:
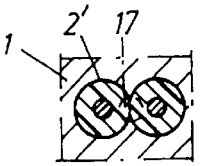
FIG. 6 is a sectional view taken on the line A—A in FIG. 5.

FIG. 5 illustrates a further development of the first body 1. Thus, FIGS. 5 and 6 illustrate a first body 1 that has a single through-passing channel 2 which receives the insulated end-parts of the cables 20 in an inlet part of the channel. The channel 2 has a cross-sectional shape that corresponds to the resultant outer contours of the tightly combined cables 20. The channel 2 will preferably have a slightly larger cross-section at the insertion end of the first body 1 than the resultant cross-section of the tightly compressed cables 20, although the channel will preferably decrease in size in a direction towards the outlet end of the channel 2.

The outlet end of the channel 2 has a cross-sectional shape (preferably a circular shape) and a cross-sectional size that is adapted so as to enable the stripped conductor end-parts 21 of the cables to pass through a channel opening 17 after being twisted together, while preventing the insulated cables from passing through said channel opening 17.

The channel 17 is conveniently centered with respect to the common cross-section of the combined cables (the cross-section of that part of the channel 2 which receives the insulated cables 20).

When connecting two or more cables 20 to a body adapted thereto, the ends of the cables are stripped and the conductor end-parts 21 twisted together, whereafter the twisted conductor line 25 is threaded through the channel 2 and through the channel opening 17, wherewith a pulling force is preferably applied to the twisted conductor line 25 so that the cables will be drawn into the channel 2 while being sealingly clamped against one another and against the wall of the channel 2. As shown in FIGS. 2 and 5, the twisted conductor line 25 is then bent and laid into a groove 6 when such a groove is provided on the outer mantle surface 5 of the first body 1, prior to fitting the second body 10 and bringing said second body into tight engagement against the ring flange 3 of the first body 1.

The first body 1 of the embodiment illustrated in FIGS. 5 and 6 is also elastically deformable under the influence of the second body 10, said first body 1 being pressed into abutment around the total perimeter of the cables 20 such that adjacent cables 20 will seal against each other and together sealingly shield the channel 2.

Figure 7:
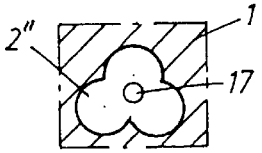
FIGS. 7–9 illustrate variants of the FIG. 6 construction.
Figure 8:
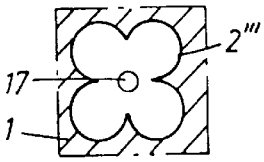
Figure 9:
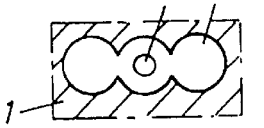

FIGS. 7, 8 and 9 are sectional views taken on the line A—A and illustrate schematically the cross-sectional shapes of the channel 2 for first bodies 1 that are adapted to accommodate different numbers of cables 20. A particular advantage afforded by the embodiment according to FIGS. 5–9 is that the conductors 21 obtain an effective electric connection in longer time perspectives, as a result of twisting the conductors together to form a twisted conductor line 25, bending the twisted conductor line 25 and optionally subjecting the twisted conductor line to a pulling force.

Figure 10:
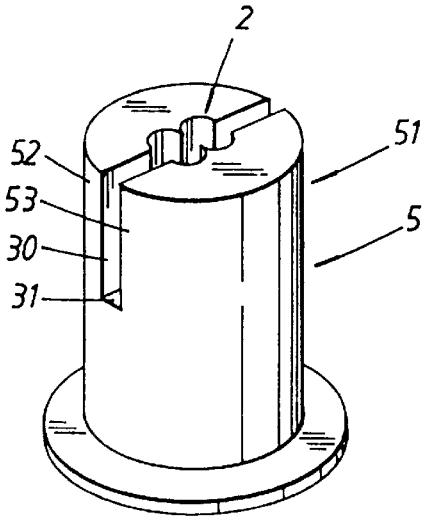
FIG. 10 illustrates another embodiment of the inner first part of the connector system.
Figure 11:
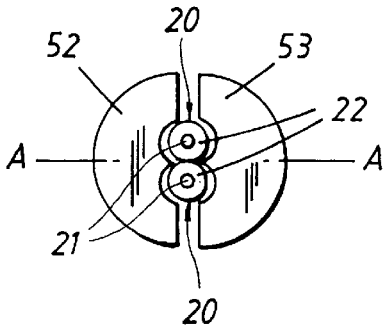
FIG. 11 illustrates a modification to the inner part shown in FIG. 10.
Figure 12:
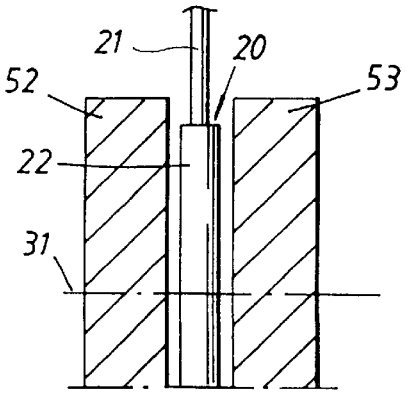
FIG. 12 is a sectional view taken on the line A—A in FIG. 11.
Figure 13:
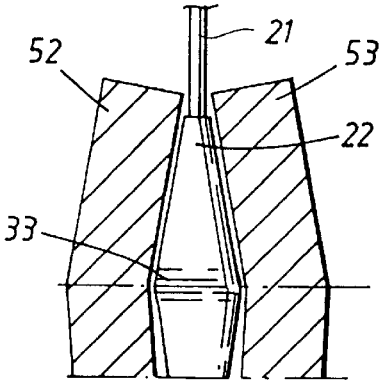
FIG. 13 is a sectional view according to FIG. 12 and shows the inner part compressed by the outer second part of said connector.

FIGS. 10–12 illustrate an alternative embodiment of a first part 5, wherein FIGS. 12 and 13 illustrate the first part 5 with cables 20 inserted in the channel 2.

As will be seen from FIGS. 10–12, the upper or slotted part 51 of the first part 5 includes a diametric slot 30 which divides the upper slotted part 51 into two tongues 52, 53 which clamp the cables 20 therebetween when an outer second body, such as that shown in FIGS. 1 and 2, is fitted, by virtue of the fact that the inner cross-section of the second body at the bottom is smaller than the non-loaded outer cross-section of the first part 5 at the top.

As shown in FIG. 13, the cable insulation 22 is caused to flow when the tongues 52, 53 are bent towards one another as a result of the wedge effect that is generated between the first part 5 and the second body, 10.

Because the tongues have a natural tendency to stretch at the bottom 31 of the slot 30, the insulation 22 will flow from the region between the tongues in a direction towards the rear end of the first part 5, therewith causing the cable insulation 22 to "swell" at or in the transition between the slotted part and the non-slotted part of the channel 2. This swelling 33 generates an effective seal between the perimeter wall of the imperforate part of the channel 2 and the cable/cables with the cables effectively sealing against one another at the same time.

The tongues 52, 53 will preferably be made of a material that is much stiffer than the cable insulation 22. The recess 14 shown in FIG. 1, in the second body 10 may taper towards the bottom, so as to force the tongues 52, 53 to stretch through contact of the second body with the tongues or through contact of the second body solely with the free ends of the tongues.

The recess in the second body 10 is suitably rotationally synergetic. The upper slotted part 51 of the first part 5 is suitably larger along the slot 30 than transversely to the slot 30 when no load acts on the upper slotted part 51, wherein the tongues 52, 53 have a cross-section such that in the state shown in FIG. 13 they will have a generally circular cross-section at their front ends.

What is claimed is:

1. A connector for receiving at least one cable having an insulated part and a stripped conductor end-part which comprises:

a first body having a through-passing cable accommodating channel and a perimeter surface, said channel having a cross-sectional shape which corresponds to an outer contour of said cable insulated part;

a second body that includes a recess for receiving the first body and said stripped conductor end-part folded down onto the perimeter surface of the first body;

said first body being radially deformable relative to the second body so as to clamp the stripped conductor end-part between said first and second bodies, and said second body being dimensioned such that when fitted onto the first body, said second body causes an axial region of the first body to be compressed so that a channel wall of the first body seals around the outer contour of said cable insulated part so as to eliminate remaining voids and seal the channel in cross-section.

2. The connector according to claim 1, wherein a mantle surface of the first body includes at least one generally axially extending groove for receiving mutually twisted stripped conductor end-parts of a number of cables, the number of cables corresponding to a number of channel openings in the first body.

3. The connector according to claim 1, wherein the second body is electrically conductive.

4. The connector according to claim 1, wherein at least one of an axially extending part-region of an inner surface of the second body and the perimeter surface of the first body is electrically conductive for electrically connecting stripped cable conductor end-parts that are clamped between adjacent surfaces of the first body and the second body.

5. The connector according to claim 2, wherein the channel in the first body has an outlet part whose cross-sectional size is smaller than a cross-sectional size of a channel inlet part but larger than a cross-sectional size of the mutually twisted conductor end-parts.

6. The connector according to claim 5, wherein the channel outlet part is centered in relation to a cross-sectional shape of the channel inlet part.

7. A connector for receiving a plurality of cables, each of said plurality of cables having an insulated part and a stripped conductor end-part, the connector comprising:

a first body having an interior channel and a generally cylindrical perimeter surface;

a second body having a generally cylindrical recess for receiving the first body and stripped conductor end-parts of said plurality of cables with said stripped conductor end-parts folded down onto the perimeter surface of the first body;

said first body being radially deformable relative to said second body so as to clamp the stripped conductor end-parts between said first and second bodies; and said interior channel having a cross-sectional shape which corresponds to an outer contour of the insulated parts of said plurality of cables received in the connector such that, when the second body is fitted onto the first body, said second body causes an axial region of the first body to be compressed so that a wall of the channel is sealed around the outer contour of the insulated parts of said plurality of cables, and the plurality of cables are sealingly pressed against one another so as to eliminate remaining voids therebetween and seal the channel against environmental corrosion.

8. The connector according to claim 7, wherein said first body further includes a peripheral ring flange with a beveled edge, and said second body further includes an edge part having on an inner surface a peripherally extending recess which coacts with the beveled edge to provide a snap joint for sealing the edge part and the ring flange around the perimeter surface of the first body.

9. The connector according to claim 7, wherein a mantle surface of the first body includes at least one generally axially extending groove that receives mutually twisted stripped conductor end-parts of the plurality of cables and directs said mutually twisted stripped conductor end-parts onto the perimeter surface of the first body.

10. The connector according to claim 7, wherein an upper part of the first body includes a slot dividing the upper part into two tongues which clamp the plurality of cables therebetween when the second body is fitted over the first body.

11. The connector according to claim 10, wherein the compression of the first body by the second body causes the insulated parts of said plurality of cables to swell at a point in the channel between the two tongues, generating an effective seal between the wall of the channel and the plurality of cables.

12. The connector according to claim 11, wherein the upper slotted part is larger along the slot than tranversely to the slot when no load acts upon the upper slotted part, said tongues, responsive to fitting of said second body, having a generally circular cross-section.

13. A connector in combination with a plurality of cables, each of which cables has an insulated part and a stripped conductor end-part, the connector comprising:

a first body having a channel and a perimeter surface;

a second body having a recess for receiving the first body and stripped conductor end-parts of said plurality of cables with the stripped conductor end-parts folded down onto the perimeter surface of the first body;

said first body being radially deformable responsive to fitting of the second body so as to clamp the stripped conductor end-parts between said first and second bodies; and the fitting of said second body further causing an axial region of the first body to be compressed so that the channel is sealed around the cable insulated parts which provide a load transfer between said plurality of cables rather than through connection of the stripped conductor end-parts.

14. The connector according to claim 13, the first body further including a peripheral ring flange with a beveled edge, and the second body further including an edge part having on an inner surface a peripherally extending recess which coacts with the beveled edge to provide a snap joint for sealing the edge part and the ring flange around the perimeter surface of the first body.

15. The connector according to claim 13, wherein an upper part of the first body includes a slot, the slot dividing the upper part into two tongues which clamp the plurality of cables therebetween.

16. The connector according to claim 15, wherein compression of the first body causes the insulated parts of said plurality of cables to swell at a point in the channel between the two tongues, generating an effective seal between the channel and the plurality of cables so as to eliminate remaining voids therebetween and thereby seal the channel against moisture.

17. The connector according to claim 13, wherein a mantle surface of the first body includes at least one generally axially extending groove that receives mutually twisted stripped conductor end-parts of the plurality of cables and directs said mutually twisted stripped conductor end-parts onto the perimeter surface of the first body.

* * * * *